US006694909B1

(12) United States Patent
Cipolla et al.

(10) Patent No.: US 6,694,909 B1
(45) Date of Patent: Feb. 24, 2004

(54) HYDRAULIC ACTIVATED TOROIDAL APERTURE GENERATION SYSTEM

(75) Inventors: Kimberly M. Cipolla, Portsmouth, RI (US); David A. Hurdis, Narragansett, RI (US); Michael R. Williams, West Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/214,522

(22) Filed: Aug. 8, 2002

(51) Int. Cl.[7] ..... B63B 21/66
(52) U.S. Cl. ..... 114/242; 114/253
(58) Field of Search ..... 114/242, 253, 114/254, 311

(56) References Cited

U.S. PATENT DOCUMENTS 3,435,471 A * 4/1969 Drennen ..... 441/65
D378,079 S * 2/1997 Lavino et al. ..... D12/317
6,135,046 A * 10/2000 Beech ..... 114/311

FOREIGN PATENT DOCUMENTS

GB 2 165 198 A * 4/1986

* cited by examiner

*Primary Examiner*—Sherman Basinger
(74) *Attorney, Agent, or Firm*—James M. Kasischke; Michael F. Oglo; Jean-Paul A. Nasser

(57) ABSTRACT

A hydraulically activated device for spacing plural towed lines includes a toroidal and inflatable tube member defining an aperture in an opening of the toroid shape. A plurality of connectors each secure a corresponding one of the plural towed lines to the toroidal and inflatable tube member. The toroidal and inflatable tube member is inflated with sea water to a predetermined volumetric configuration suitable to an operating speed range of the towed lines and upon inflation will space the towed lines in a three-dimensional arrangement therearound. A sheath may also be formed around the toroidal and inflatable tube member, the sheath being formed in cross section as a tear drop or similar streamlined shape.

18 Claims, 3 Drawing Sheets

HYDRAULIC ACTIVATED TOROIDAL APERTURE GENERATION SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

This invention generally relates to a spacing device for towed arrays.

More particularly, the invention relates to a hydraulically activated toroidal aperture generation system in which spacing is provided for towed arrays.

(2) Description of the Prior Art

The current art for an aperture generation system is a passive system presently used by the Near Term Multi-Line Towed Array (NTMLTA). This known system cannot be used to vary the relative location of the individual towed lines. In addition, there are concerns regarding the reliability, manufacturability and environmental compatibility of the current known system.

Accordingly, a problem exists in the art of multiple line towed arrays to provide a means for reliably generating and maintaining separation of the lines in a specified three-dimensional configuration. Any system for aperture generation (or generation of a mechanically maintained, three-dimensional spacing between the towed lines) must be compatible with the method of deploying and retrieving the towed system. For the present technology, this requires that the aperture generation system collapse to a significantly reduced volume prior to retrieval. An ideal system would also operate automatically with no power or outside intervention. Accordingly, any new system must operate under the following constraints:

Maintain separation distances across relevant operation speed ranges; Allow deployment and retrieval of the towed system and proper operation of the sensors; Survive flank speed of tow platform; Operate reliably in a seawater environment, temperature range compliance, hydrostatic pressure compliance, and material compatibility; and Maintain performance for a minimum of three months without maintenance in a submarine environment.

The following patents, for example, disclose towed lines and cable arrangements, but do not disclose a hydraulically activated device for vertically and horizontally separating plural towed arrays.

U.S. Pat. No. 4,108,101 to Schirtzinger;

U.S. Pat. No. 4,726,315 to Bell et al.;

U.S. Pat. No. 4,958,331 to Wardle;

U.S. Pat. No. 5,835,450 to Russell;

U.S. Pat. No. 5,855,179 to Wood;

U.S. Pat. No. 5,863,440 to Rink et al.;

U.S. Pat. No. 5,983,821 to Williams;

U.S. Pat. No. 6,058,072 to Abraham; and

U.S. Pat. No. 6,143,172 to Rink et al.

Specifically, Shirtzinger discloses an arrangement for transporting in which a self-propelled surface vessel tows a submergible elongated cargo container by means of a semi-rigid boom extending from the stern of the vessel to the nose of the cargo container. The position of the boom is controlled from the stern of the vessel to hold the nose of the container at a level below the wake of the towing vessel.

The patent to Bell et al. discloses a ship provided with booms that may be extended outwardly from the ship. Geophysical devices of different genera are towed from the booms, in the water behind the ship. A UHF antenna is located at the outboard top of each boom. A line joining the two antennas defines a long reference base line for determining the absolute heading of the ship with respect to a meridian and to locate the absolute positions of selected towed geophysical devices with respect to two-dimensional space. The booms may be automatically oriented along a line perpendicular to the ship's track, independently of the ship's heading.

Wardle discloses a mobile sonar surveillance system having a fully populated circular shaped horizontal receiving array steered in edgefired directions with overlapping coverage of beams. The array has a plurality of hydrophones randomly spaced and mounted on a series of parallel lines in the same horizontal plane and is suitable for towing by a single small ship. For alignment of a received signal, one or more single beams suitable for rotation can be steered azimuthally with the proper set of synchronized variable delays. These beams will retain approximately the same parameters as they rotate.

Russell discloses a system for transmitting signals between a plurality of towed sensor streamers and a seismic vessel, the system comprising: a plurality of seismic streamers, wherein each streamer of the plurality of seismic streamers comprises: a leading end, a trailing end, a plurality of sensors located therein and a transmitter of seismic signals received by the plurality of sensors to a terminal located in the leading end of the streamer; at least one spreader located between the streamers, the spreader comprising: connectors for connecting to the terminals of the streamers, a spreader terminal, and a spreader transmitter of signals between the connectors and the spreader terminal; a lead-in having a lead-in connector for connecting to the spreader terminal and a transmitter of signals between the lead-in connector and the seismic vessel. A seismic streamer system is disclosed comprising: a lead-in, and multiple streamers; wherein the multiple streamers are signal-connected to the lead-in, and wherein at least two of the streamers are signal-connected by at least one spreader. A process is disclosed comprising: transmitting signals between at least two streamers of a plurality of streamers; transmitting signals between a first lead-in and the plurality of streamers; and transmitting signals between the first lead-in and the vessel. A process is disclosed comprising: transmitting signals between each streamer of the plurality of streamers and a spreader bus; transmitting signals between the spreader bus and at least one lead-in, wherein the number of streamers of the plurality of streamers is greater than the number of lead-ins; and transmitting signals through at least one lead-in to the vessel.

The patent to Wood discloses a towed array handling system for installation within the enlarged sails of future submarines. The system has a large diameter reel that provides storage for the entire array and tow cable when not deployed. The area within the enlarged sail is sufficient to allow for a dual winch and reel system for separately storing and deploying single line and/or multi line arrays. The reel applies the full tension of the streamed array as it is deployed and retrieved. When locked, the reel applies the full array streaming tension during high-speed tow. The towed array is ducted from the winch to an amidships tow point via a guide path through a ballast tank which contains only two bends. The upper sheave at the bend closest to the winch is free-wheeling and the lower sheave is part of a transfer device which pulls the array from the winch during the initial phase of deployment. The guide duct is aligned with the winch to provide even spooling of the array, especially the multi line array, onto the winch.

Rink et al. '440 discloses a :plurality of water- and oil-porous sacks partially filled with a number of generally toroidal bodies of a polymer material that entraps oil and including mesh fragments scattered throughout the bodies. Each sack is sewn with a perimeter stiffening ring, to retain a flat profile, and has a netting that closes to help inhibit outflow of the oil when the sack is retrieved. When deployed from ship or by air onto a spill, the sacks spread into a pancake shape and the polymer matter forms a single layer that retains the oil. The sacks will float indefinitely without releasing the oil or allowing it to emulsify, so the oil can remain in place until collection efforts are feasible. The sacks can be burned in situ, or standard fishing boats or specialized collection boats can be burned to capture the energy content of the oil or processed to separate the oil from the polymer. The sacks can be used in conjunction with other, known containment or retrieval equipment, such as booms or skimmers. The system is specifically designed for rapid deployment and efficiency in rough water.

The patent to Williams discloses a multiline tow cable assembly including swivel area components and slip ring components. The swivel area components include a rotor member connected to an external housing, at least one contact member formed within the rotor member and rotatable with the rotor, and first electrical leads connected to the at least one contact member. The slip ring components include a multiline termination member, a stator connected to the multiline termination member, at least one contact pin formed in connection with the stator, and second electrical leads connected to the at least one contact pin. A substantially friction free member is interposed between the swivel area components and the slip ring components for enabling relative rotation of the swivel area components with respect to the slip ring components. With the described assemblies, continuous electrical connection is maintained between the first and second electrical leads upon rotation of the swivel area components with respect to the slip ring components.

Abraham discloses a system and method for reducing flow-induced noise in an underwater towed system. The system includes at least one neutrally buoyant towed array, a tow platform for defining a tow direction of the at least one towed array, a neutrally buoyant tow cable connected to the at least one towed array and the tow platform, and a deploy and retrieve apparatus for deploying and retrieving the tow cable. The deploy and retrieve apparatus is connected to both the tow cable and the tow platform. Deployment of the tow cable from the deploy and retrieve apparatus correspondingly deploys the at least one towed array, and retrieval of the tow cable with the deploy and retrieve apparatus correspondingly retrieves the at least one towed array. The speed of deployment of the tow cable can be varied to decrease the velocity of the towed array relative to the surrounding water thus reducing flow-induced noise.

Rink et al. '172 discloses a plurality of water- and oil-porous sacks partially filled with a number of generally toroidal bodies of a polymer material that entraps oil and including mesh fragments scattered throughout the bodies. Each sack is sewn with a perimeter stiffening ring, to retain a flat profile, and has a netting that closes to help inhibit outflow of the oil when the sack is retrieved. When deployed from ship or by air onto a spill, the sacks spread into a pancake shape and the polymer matter forms a single layer that retains the oil. The sacks will float indefinitely without releasing the oil or allowing it to emulsify, so the oil can remain in place until collection efforts are feasible. The sacks can be burned in situ, or standard fishing boats or specialized collection boats can be used to retrieve the sacks, and the collected material can be burned to capture the energy content of the oil or processed to separate the oil from the polymer. The sacks can be used in conjunction with other, known containment or retrieval equipment, such as booms or skimmers. The system is specifically designed for rapid deployment and efficiency in rough water.

It should be understood that the present invention would in fact enhance the functionality of the above patents by providing a hydraulically actuated and toroidal spacing device for three-dimensional spacing of multiple underwater towed arrays. The towed arrays are further able to be selectively secured to desired locations of the toroidal spacing device and the toroidal spacing device is made to be streamlined for an underwater environment.

SUMMARY OF THE INVENTION

Therefore it is an object of this invention to provide a spacing device for easily and automatically separating towed lines in a three-dimensional arrangement.

Another object of this invention is to provide a spacing device hydraulically inflatable for automatically separating towed lines in a three-dimensional arrangement.

Still another object of this invention is to provide a hydraulically inflatable spacing device on which plural towed lines are removably secured.

A still further object of the invention is to provide a hydraulically inflatable toroidal spacing device on which plural towed lines are removably secured.

Yet another object of this invention is to provide a hydraulically inflatable toroidal spacing device on which plural towed lines are removably secured and which is streamlined in an underwater environment.

In accordance with one aspect of this invention, there is provided a hydraulically activated device for spacing plural towed lines in a three-dimensional arrangement that includes a toroidal and inflatable tube member defining an aperture in an opening of the toroid shape. A plurality of connectors each secure a corresponding one of the plural towed lines to the toroidal and inflatable tube member. The toroidal and inflatable tube member is inflated with sea water to a predetermined volumetric configuration suitable to an operating speed range of the towed lines and upon inflation will space the towed lines therearound in a desired pattern. A sheath may also be formed around the toroidal and inflatable tube member, the sheath being formed in cross section as a tear drop or similar streamlined shape.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
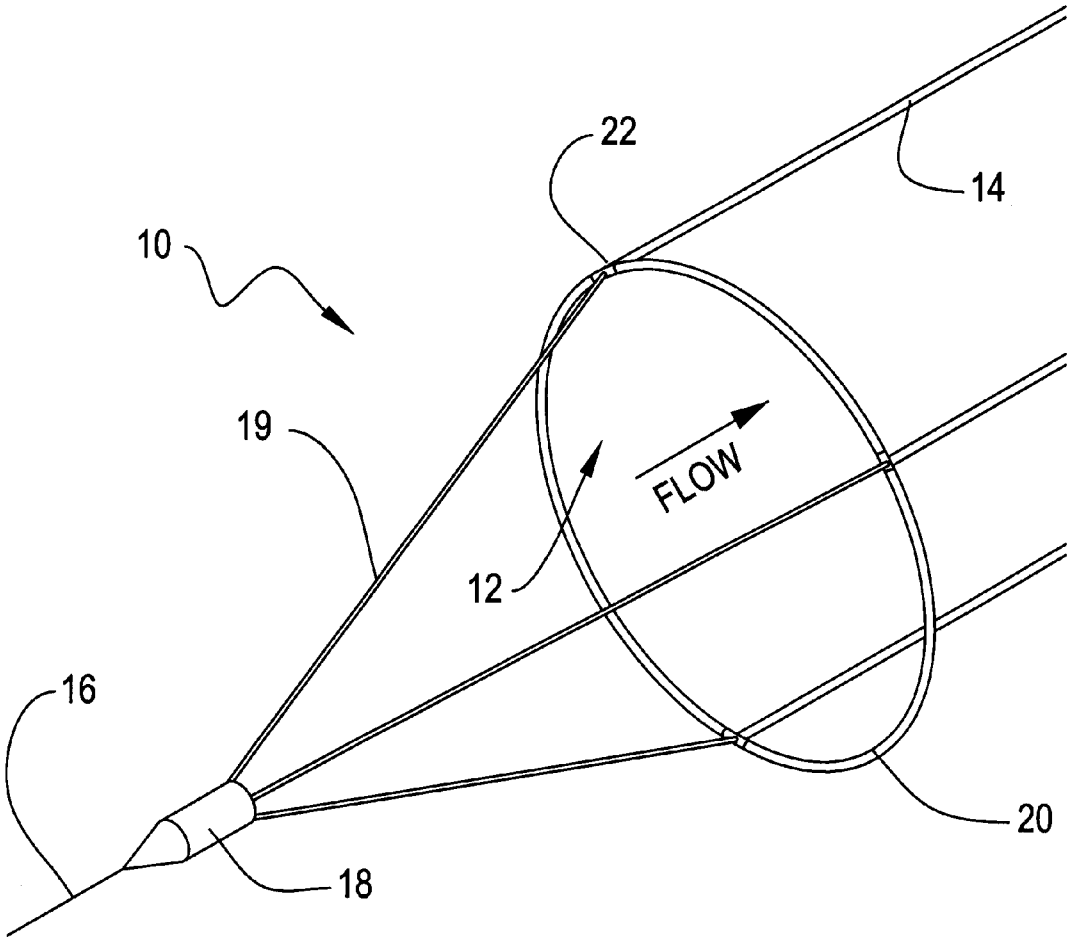
FIG. 1 is a perspective view of a toroidal aperture generation system according to the present invention.

In general, and referring first to FIG. 1, the present invention is directed to a hydraulically activated toroidal aperture generation system 10, having been given the acronym of "HATAGS". The system 10 generates a volumetric spacing aperture at 12 for multiple lines of towed arrays 14 and thereby generates radial separation among the individual lines of the towed arrays 14 of a towed system.

The hydraulically activated toroidal aperture generation system 10 includes the plural array lines 14, each of which is connected at a fore end thereof to a tow cable 16 or the like. A gathering member 18 is shown as the collection point for leader lines 19 which can transfer data to and from the towed array lines 14. Connection of the leader lines 19 at that point is known in the art.

Figure 1A:
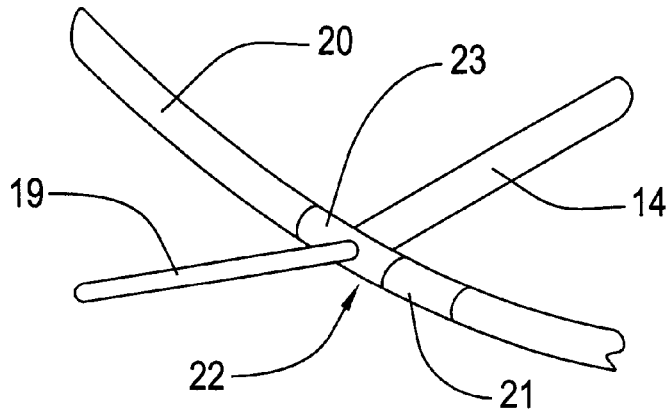
FIG. 1A is a perspective view of a detail of the toroidal aperture generation system shown in FIG. 1.

A hollow, toroidal tubing 20 fills with seawater to a required or desired inflation pressure. The tubing 20 is circular in cross section to maximize structural rigidity and to enable a uniform inflation pressure therein. The hollow toroidal tube 20 is constructed from a high strength woven fabric and functions by filling with seawater as described. The required pressure within the filled tube 20 is defined by the desired volumetric configuration and operating speed range of the device 10. Inflation of the toroidal tube 20 can be accomplished either passively by an osmotic infusion of water therein or through a pumping mechanism (FIG. 1A). A pumping mechanism, if utilized, would be active only during the initial inflation of the tubing 20 and therefore would not affect the acoustic performance of the towed system.

The individual lines 14 of the multiple line system 10 are attached to the expandable tube 20 on the outside circumference thereof at attachment locations 22. FIG. 1A shows an attachment location. At these locations, a connector 23 attaches leader line 19 to a corresponding towed array line 14. Optionally, a pump 21 can be located near leader line 19 if power is required. Pump 21 can include a valve for equalizing pressure and collapsing tube 20. The attachments do not interfere with the acoustic operation of the towed system and allow quick disconnect for maintenance and replacement. An actual structure of the connector 23 at the attachment point 22 is not specified herein, as it will be understood that any suitable attachment arrangement known in the art may be utilized to removably connect the array lines 14 to the hydraulically activated toroidal aperture generation system 10.

Alternate volumetric configurations of the aperture 12 may easily attained by movement of the attachment locations 22. For example, positioning of the attachment locations in equal groups at opposing sides of the tubing will result in an ellipse shape of the aperture 12, whereas a more uniform spacing of the attachment locations will yield a more nearly circular aperture. Further, a variable number of lines 14 can be accommodated easily by adding or removing attachment locations 22.

Figure 2:
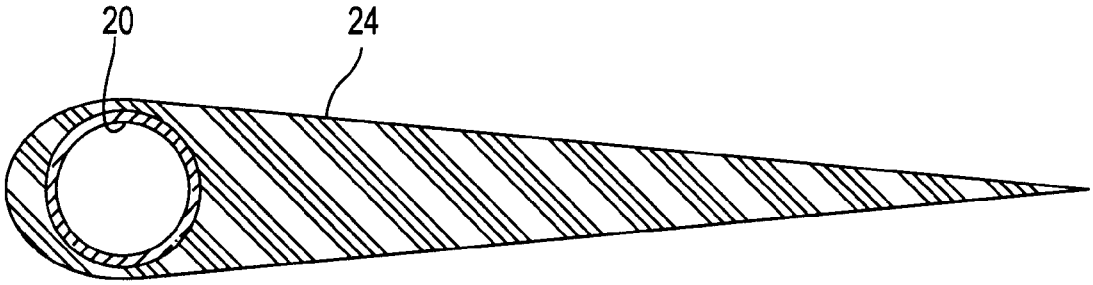
FIG. 2 is a cross sectional view of a shaped sheath for a toroidal tube of the system in FIG. 1.
Figure 3:
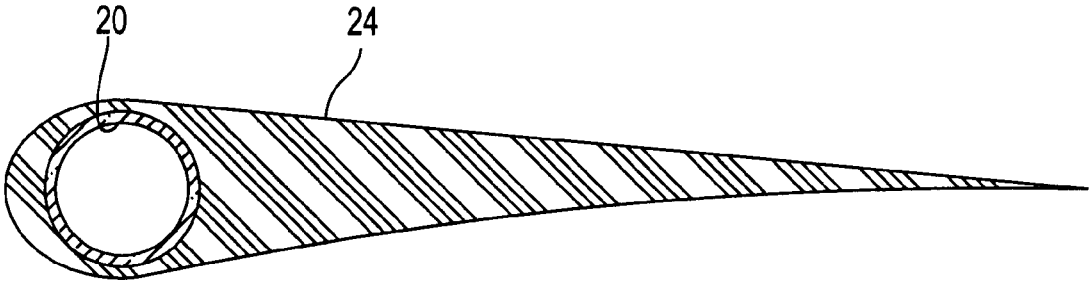
FIG. 3 is a cross sectional view of an alternative shaped sheath according to the present invention.
Figure 4:
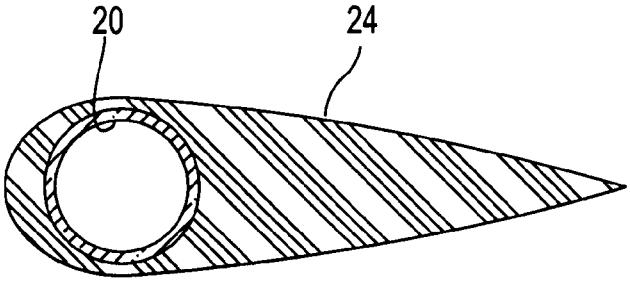
FIG. 4 is a cross sectional view of a further alternative shaped sheath according to the present invention.

As shown in FIGS. 2 through 4, an external shaped sheath 24 surrounds the load bearing tube 20. The cross-sectional shape of this sheath 24 is designed to minimize drag and optimize the aperture generating capacity of the system. Specifically, the shape of the sheath 24 can be used to augment the separation of the multiple tow lines 14 where desired and can vary circumferentially. Some sample sheath cross sections are shown in FIGS. 2 through 4. These sample sheaths shapes 24 are not intended to be limiting of the invention and are shown by way of example. The predominant characteristic of a sheath 24, however, will be the streamlining it imparts to a particular load bearing tube 20. The sheath 24 will also be coated to minimize both the skin friction coefficient and marine growth and to ensure compatibility with the seawater environment.

Figure 5:
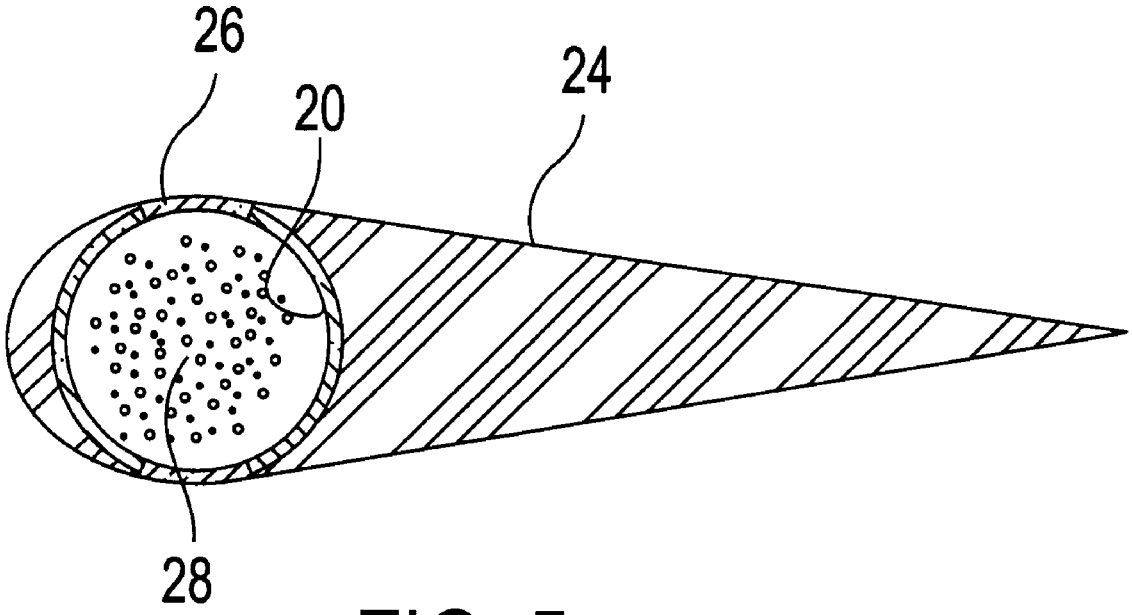
FIG. 5 is a cross sectional view showing the osmotic inflation system according to the present invention.

FIG. 5 shows an osmotic inflation system which can be used for inflating the tube 20. In using the osmotic inflation system, regions of tube 20 are made from a semi permeable membrane 26 and a concentrated solute 28 is positioned within tubing 20. Membrane 26 is in communication between tube 20 interior and the external environment. Osmotic pressure acts to inflate the tube 20 when tube 20 is placed in environmental fluid having a lower concentration of solute. The passive introduction of water into the tubing 20 is anticipated to be to a point of equilibrium between the contents of the tube 20 and the outside seawater environment. A remotely controlled valve positioned at the same location as pump 21 in FIG. 1A can be provided for collapsing tube 20.

Accordingly, the hydraulically activated toroidal aperture generation system 10 quickly and easily generates a volumetric aperture at 12 for multiple lines 14 of a towed system.

There are many advantages resulting from the present invention, including the substantially reduced number of parts and complexity when compared to current aperture generation systems. The inventive system utilizes new high strength, flexible materials and advanced manufacturing techniques while providing a significant cost reduction over present aperture generation systems.

Further, the toroidal aperture generation system 10 is compatible with specifications for current towed array operations and survival and therefore can be implemented in existing multiple line towed systems. Also the geometry is such that it has no impact on current towed array stowage tube or handling systems. Further, since the entire system is constructed from a fabric type material, there is negligible impact on the array performance or self-noise.

The system produces an aperture independent of the tow speed of the platform. In contrast, the aperture of current multiple line towed systems that rely on lifting surfaces can vary up to 50% over the operating speed range.

Even further, the present invention will accommodate various volumetric aperture configurations 12 by moving the location of the attachments points 22 and/or modifying the number of lines 14 without any other design changes.

Finally the system of the present invention contains few or no metal components, thereby significantly increasing compatibility with the marine environment. Current systems rely heavily on high precision metal parts and interfaces that are susceptible to marine growth and deposits.

In view of the above detailed description, it is anticipated that the invention herein will have far reaching applications other than those disclosed herein.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A device for spacing plural towed array lines in a three-dimensional arrangement comprising:

at least two leader lines;

an inflatable tube member joined to said at least two leader lines; and a plurality of connectors positioned on said inflatable tube member, each connector securing a corresponding one of said plural towed array lines to said inflatable tube member.

2. The device according to claim 1 wherein said inflatable tube member is hydraulically inflated.

3. The device according to claim 1 wherein said device is operable in an underwater environment and said inflatable tube member is hydraulically inflatable.

4. The device according to claim 3 wherein said inflatable tube member is formed of a toroidal hollow tube.

5. The device according to claim 4 wherein said toroidal hollow tube is a high strength woven fabric.

6. The device according to claim 1 further comprising a sheath covering said inflatable tube member.

7. The device according to claim 6 wherein said sheath is a substantially teardrop shape and houses said inflatable tube member in the largest diameter cross-section thereof.

8. The device according to claim 6 wherein said each of said plurality of connectors connect said towed array lines directly to said sheath.

9. The device according to claim 1 wherein each of said plurality of connectors connect one said towed array line directly to said inflatable tube member.

10. A spreader for an acoustic array for towing by a tow cable comprising:

a gathering member for joining to the tow cable;

a plurality of leader lines joined at a first end to said gathering member;

an inflatable tube member joined to the second end of said plurality of leader lines, said inflatable tube member defining an inner volume; and a plurality of connectors in communication with at least one of said plurality of leader lines, said connectors being positioned on said inflatable tube member and connectable to the acoustic array.

11. The device of claim 10 wherein each leader line corresponds to one said connector.

12. The device of claim 10 further comprising an osmotic inflation system joined in communication between said inflatable tube member and environmental fluid for inflating said inflatable tube member when said inflatable tube member is subjected to environmental fluid.

13. The device of claim 12 wherein said osmotic inflation system comprises:

a semipermeable membrane in communication between the environment and said inflatable tube member inner volume; and a solute positioned in said inflatable tube member inner volume.

14. The device of claim 10 further comprising a pump joined in communication between said inflatable tube member and environmental fluid for inflating said inflatable tube member.

15. The device of claim 10 wherein said inflatable tube member defines a toroidal shape on inflation.

16. The device of claim 15 further comprising a sheath covering said inflatable tube member.

17. The device of claim 16 wherein said sheath has a hydrodynamic cross section, said inflatable tube member being located in the largest diameter region of the hydrodynamic cross section.

18. The device of claim 17 wherein said hydrodynamic cross section provides forces for sustaining the toroidal shape when towed.

* * * * *